US005768899A

United States Patent [19]

Lee et al.

[11] Patent Number: 5,768,899

[45] Date of Patent: Jun. 23, 1998

[54] ICE MAKER WITH MECHANISM FOR DETERMINING A POSITION OF AN ICE-MAKING TRAY

[75] Inventors: Gun Il Lee, Seoul; Jae Eok Shim, Gunpo, both of Rep. of Korea

[73] Assignee: Samsung Electronics Co., Ltd., Suwon, Rep. of Korea

[21] Appl. No.: 755,540

[22] Filed: Nov. 21, 1996

[30] Foreign Application Priority Data

Dec. 22, 1995 [KR] Rep. of Korea ..... 95-54792

[51] Int. Cl.[6] ..... F25C 5/18

[52] U.S. Cl. ..... 62/137; 62/353

[58] Field of Search ..... 62/137, 353, 351

[56] References Cited

U.S. PATENT DOCUMENTS

| | | | |
|---|---|---|---|
| 2,994,206 | 8/1961 | Shaw et al. | 62/137 |
| 3,208,233 | 9/1965 | Linstromberg | 62/137 |
| 3,382,682 | 5/1968 | Frohbieter | 62/137 |
| 3,643,456 | 2/1972 | Nichols | 62/137 |
| 4,719,762 | 1/1988 | Osabe | 62/137 |

*Primary Examiner*—William E. Tapoical
*Attorney, Agent, or Firm*—Burns, Doane, Swecker & Mathis, L.L.P.

[57] ABSTRACT

An automatic ice maker includes an ice-making tray rotatable between an upright ice-making position, and an inverted ice-discharging position. A container disposed beneath the tray receives the discharged ice. A cam wheel rotates with the tray and includes first and second cams that actuate first and second switches, respectively. A controller connected to the switches determines the position of the tray on the basis of the states of the switches. A lever detects whether the container is full of ice. When the container is full, the lever actuates the second switch in order to prevent further ice-making operations, regardless of the orientation of the first and second cams.

5 Claims, 9 Drawing Sheets

ICE MAKER WITH MECHANISM FOR DETERMINING A POSITION OF AN ICE-MAKING TRAY

RELATED INVENTIONS

This invention is related to inventions disclosed in U.S. application Ser. No. 08/757,548 of Gun Il Lee filed Nov. 27, 1996, and in U.S. application Ser. No. 08/757,753 of Kun Bin Lee and Jae Eok Shim, filed Nov. 26, 1996.

FIELD OF THE INVENTION

The present invention relates generally to an ice maker for a refrigerator.

BACKGROUND OF THE INVENTION

FIG. 3 depicts a refrigerator having a conventional ice maker. The refrigerator includes a body 1, and a freezing compartment 3 and refrigerating compartment 4 which are separated by a partition 2. The freezing and refrigerating compartments 3 and 4 are accessible by the opening of two doors 5 and 6 to the freezing compartment 3 and refrigerating compartment 4, respectively. A cooler 7, which cools air, is provided behind the freezing compartment 3. The cool air from the cooler 7 is forcedly circulated in the freezing compartment 3 and refrigerating compartment 4 by a fan 8 installed above the cooler 7. To guide the flow of this cool air, a front plate 9 and a rear plate 10 are installed in front of and adjacent to the fan 8, respectively. Formed in the front plate 9 is an outlet 11 which discharges the cool air into the freezing compartment 3, and at the rear plate 10 there originates a duct 12 which supplies the cool air into the refrigerating compartment 4.

An ice maker 20, mounted in the freezing compartment 3, utilizes the cool air generated by the cooler 7 to turn water into ice. The ice maker 20 consists of an ice making container 21 having a plurality of concave portions 21' which hold the water as it freezes and an ice reservoir 22 which stores ice cubes already made in the ice making container 21. Further, a water reservoir 23 and a water supply pump 24 are provided for supplying water from the water reservoir 23 to the ice making container 21 in the refrigerating compartment 4. A hose 25 is disposed to extend from the water reservoir 23 to the upper portion of the ice making container 21. Through the hose 25 the water from the water reservoir 23 is fed to the ice making container 21. An operating member 26 is provided at the front of the ice making container 21, and serves to cause the ice cubes inside the ice making container 21 to be transferred into the ice reservoir 22. It does this by twisting the ice making container 21 approximately at an angle of 135°.

FIG. 4 schematically depicts the overall outward appearance of the conventional ice maker 20.

The ice making container 21 is integrally joined to the operating member 26. The ice reservoir 22 is placed under the ice making container 21. The ice reservoir 22 can be removed from the freezing compartment 3 so that the ice cubes can be easily transported from the freezing compartment 3. The ice making container 21 is swung about both its ends by a rotating force generated by an electric motor 30. An ice level checking lever 45 and an ice level checking switch 46 are provided to stop the ice dropping mode when the ice reservoir 22 is full of ice cubes. In such an ice maker 20 the water supplying and ice making mode and ice dropping modes are carried out automatically and successively by a control portion (not illustrated).

FIG. 6 shows the conventional operating member 26 for performing the ice dropping mode. The operating member 26 includes the motor 30 for generating a rotating force; a pair of reduction gears 33 that transfer and reduce the speed of the rotating force of the motor 30; and a cam gear 35, which meshes with the reduction gears 33, fixed to the ice making container 21 to turn the ice making container 21.

The operating member 26 also includes first and second horizontal position sensing switches 40 and 41 which are turned on and off according to the rotation of the cam gear 35 to detect whether the ice making container 21 is in a horizontal (upright) or turned (inverted) position; and an ice level checking lever 45 (refer to FIG. 4) and ice level checking switch 46 which determine if the ice reservoir 22 is full.

As shown in FIGS. 5 and 6, first and second grooves 37 and 38 are formed on the outer circumference of the cam member 36 and oppositely disposed with respect to each other; the cam member 36 is connected to one side of the cam gear 35. While the first groove 37 is formed on the inner axial end of the cam member 36 in order to face the first horizontal position sensing switch 40, the second groove 38 is provided on the outer axial end of the cam member 36 to face the second horizontal position sensing switch 41.

As the cam gear 35 rotates, the first groove 37 comes into contact with the horizontal position sensing switch 40, whereby the switch 40 is turned off while the second horizontal position sensing switch 41 remains on. When the second groove 38 contacts the second horizontal position sensing switch 41, it is turned off while the first horizontal position sensing switch 40 remains on.

The control portion (not illustrated) controls the execution of the ice dropping mode by determining the position of the moving ice making container 21 according to combined signals of the first and second horizontal position sensing switches 40 and 41. In other words, when the first horizontal position sensing switch 40 is off and the second horizontal position sensing switch 41 is on, the control portion determines that the ice making container 21 is in a horizontal (upright) position. Alternatively, when the first and second horizontal position sensing switches 40 and 41 are on and off, respectively, the control portion determines that the ice making container 21 has been twisted to its maximum angle. When both switches 40 and 41 are on, the control portion determines that the ice making container 21 is in the process of turning.

When the ice reservoir 22 is filled with the ice cube, the lever 45 turns off the switch 46 so as to inform the control portion that the ice reservoir 22 is full so it should stop the ice dropping mode until the ice reservoir 22 is emptied.

The conventional operating member 26 uses the pair of switches 40 and 41 to control the ice dropping mode of the ice maker, and additionally, uses the switch 46 to monitor the quantity of the ice cubes in the ice reservoir 22. Such a conventional operating member 26 cannot utilize these switches efficiently, and is of complicate construction.

More specifically, the control portion requires output signals of the two horizontal position sensing switches 40 and 41 to determine if the ice making container 21 is in a horizontal position, rotating, or twisted to its maximum angle. Besides, the control portion uses an output signal of the switch 46 to stop the ice-dropping mode once the ice reservoir 22 is full. Such a conventional ice maker is designed to have a pair of switches used for controlling the ice dropping mode and another switch for controlling a verifying try-out, and is thus increased in size and complicated in structure.

SUMMARY OF THE INVENTION

The present invention is directed towards an ice maker for a refrigerator which obviates the aforementioned problems and disadvantages of the conventional art.

It is the objective of the present invention to provide an ice maker for a refrigerator of which a horizontal position sensing switch used to control the ice dropping mode and an ice level checking switch employed to control the ice level checking mode are electrically combined with each other so as to be of simple structure and provide good performance.

In order to obtain this objective, there is provided an ice maker for a refrigerator with a freezing compartment and a refrigerating compartment, including a motor which produces a rotating force used to turn an ice making container housed in the freezing compartment to cause the ice cubes made therein to drop into an ice reservoir disposed under the ice making container; a reduction gear assembly and a cam gear which serve to rotate the ice making container by using the rotating force generated by the motor; and a horizontal position sensing switch turned on or off by the rotation of the cam gear in order to control the ice making mode. The inventive ice maker also includes an ice level checking switch, that is turned on or off by the rotation of the cam gear, in order to check the quantity of ice cubes contained in the ice reservoir, and a ice level checking lever that determines whether the ice reservoir is full.

In this ice maker, a cam member is integrally formed on one side of the cam gear to actuate the horizontal position sensing switch, the ice level checking switch, and the ice level checking lever. This cam member includes a first cam formed inside the cam member to turn on or off the horizontal position sensing switch, and a second cam which extends from the first cam to actuate the ice level checking switch and the ice level checking lever. As the cam gear rotates, the first cam and the second cam serve to turn on or off the horizontal position sensing switch and ice level checking switch.

The first cam includes a rounded portions and first and second concave portions formed on its outer surface. Thus, when the lever of the horizontal position sensing switch comes in contact with the first and second concave portions, the switch is turned off, and when the switch's lever comes in contact with the rounded portion, it is turned on. The ice level checking lever has a first arm member and a second arm member which are moved around a predetermined point of the ice level checking lever in opposite directions to each other, and the first arm member is disposed between the second cam and the ice level checking switch.

The second cam is semicircular in shape and has a flat portion and a rounded portion. As the rounded portion comes in contact with the first arm member, the first arm member depresses the lever of the ice level checking switch to turn on the ice level checking switch, and when the flat portion contacts the first ram member, the lever of the switch returns to its original state to thereby turn off the ice level checking switch.

BRIEF DESCRIPTION OF THE DRAWINGS

FIGS. 2A to 2D are sectional views of the operating member of the inventive ice maker in different stages of operation as taken along line II—II in FIG. 1, wherein FIG. 2A depicts the ice making container in the horizontal (upright) position for ice-making FIGS. 2B and 2C show the ice making container in intermediate stages of turning, and FIG. 2D shows the cam gear's position after the ice making container is twisted to its maximum angle;

DETAILED DESCRIPTION OF THE PREFERRED EMBODIMENT

The preferred embodiment of the present invention will be now described in detail with reference to the accompanying drawings.

Figure 1:
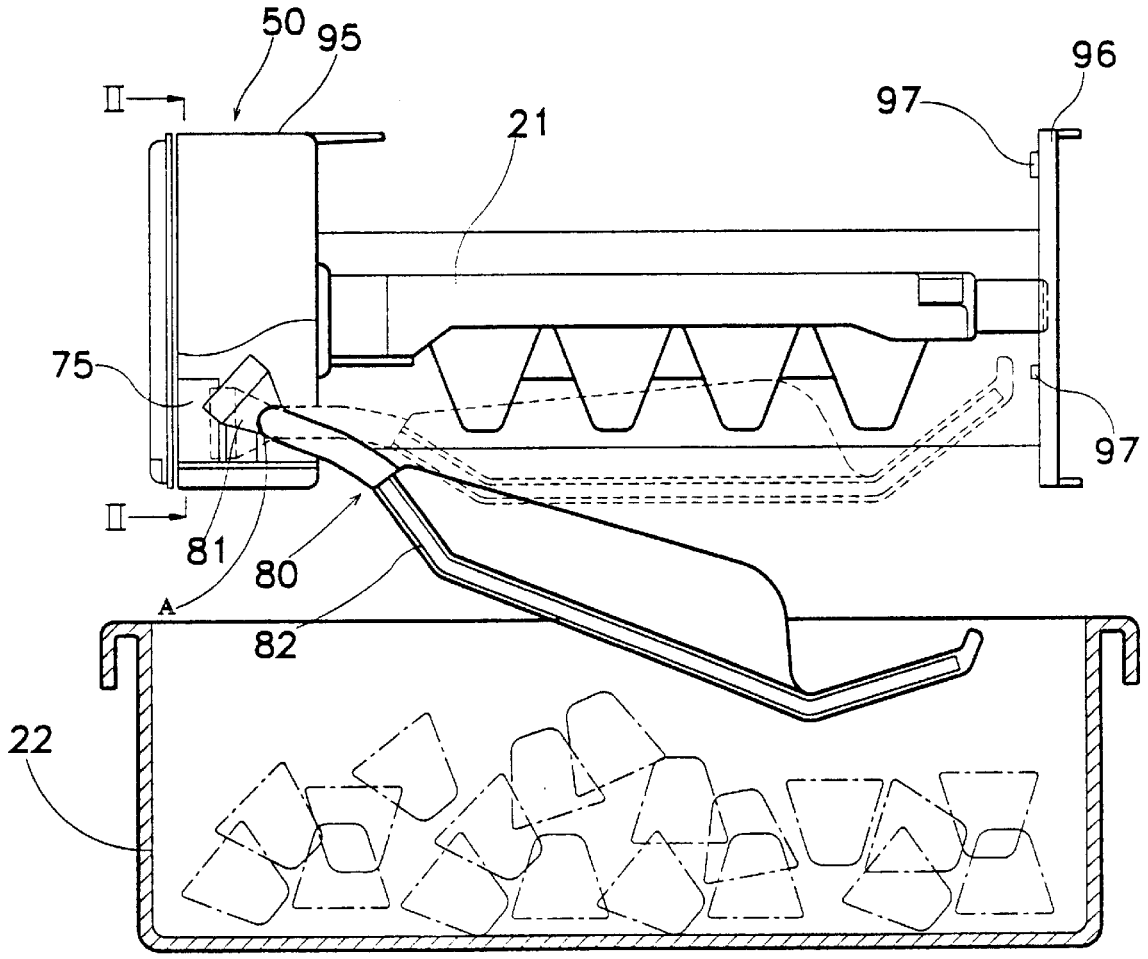
FIG. 1 depicts the overall outward appearance of an ice maker according to the present invention.

FIG. 1 depicts the overall outward appearance of an ice maker according to the present invention.

Figure 2A:
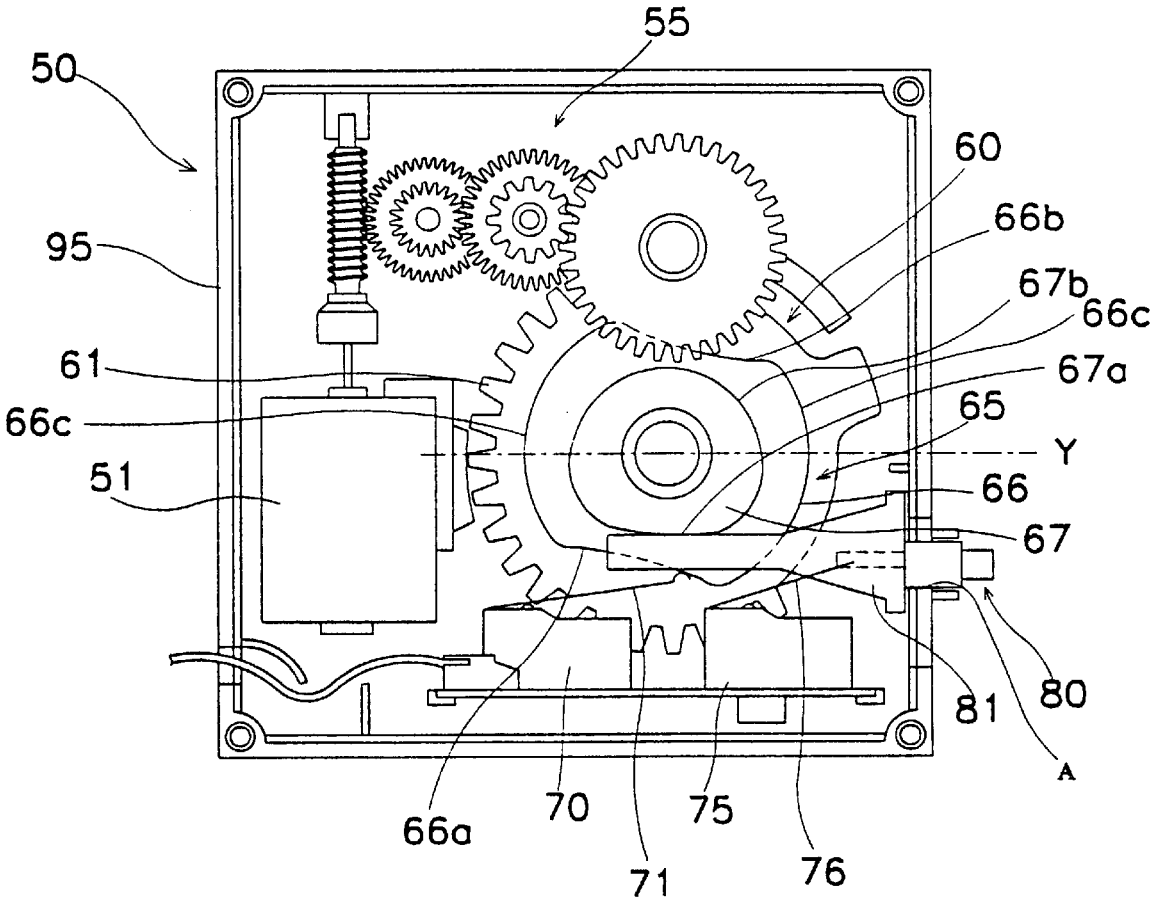

FIG. 2A depicts the operating member 50 when its ice making container 21 is in the horizontal (upright) position.

The operating member 50 of the inventive ice maker includes the following components in a case 95: a motor 51 which generates a rotating force; a reduction gear assembly 55 which reduces a rotation speed of the motor 51 and delivers the rotating force of the motor 51 to a control portion (not illustrated); and a cam gear 60 which meshes with the reduction gear assembly 55 and is fixed to the ice making container 21 thereby enabling it to twist the container 21.

The operating member 50 also has a horizontal position sensing switch 70 and an ice level checking switch 75, the latter serving to control its ice dropping mode and ice level checking mode. An ice level checking lever 80 assists the function of the ice level checking switch 75 by being moved up and down depending on the quantity of ice cubes in an ice reservoir 22 so as to operate the ice level checking switch 75.

The cam gear 60 consists of a gear 61 and a cam member 65 integral with the gear 61. A first cam 66 is formed on the cam member 65 to operate the horizontal position sensing switch 70, and a second cam 67 is also formed on the cam member 65 to operate the ice level checking switch 75. The first cam 66 has a first concave portion 66*a* and a second concave portion 66*b* oppositely disposed respective to each other on its outer surface, and two rounded portions 66*c* formed at the locations on the outer surface where the first and second concave portions 66*a* and 66*b* are not formed.

The horizontal position sensing switch 70 is arranged to be turned off when its lever 71, during the rotation of the first cam 66, comes in contact with the first or second concave portions 66*a* and 66*b*, and turned on when its lever 71 is in contact with the rounded portions 66*c*. The second cam 67 is semicircular in shape and has a flat portion 67*a* and a rounded portion 67*b*. The ice level checking switch 75 is turned off when its lever 76 is in contact with the flat portion 67*a* during the rotation of the second cam 67, and is turned on when the lever 76 contacts the rounded portion 67*b*.

As shown in FIG. 1, the ice level checking lever 80 consists of a first ram member 81 and a second ram member 82 that are rotated about the axis A in opposite directions to each other i.e., when member 81 rises, member 82 descends and vice versa. The first ram member 81 is disposed between the second cam 67 and the ice level checking switch 75. The ice level checking switch 75 is turned on and off as the first ram member 81 is moved up and down respectively, with the rotation of the first cam 67.

The ice making container 21 has one end connected to the cam gear 60 and the other end rotatably held by a support 96 integrally coupled with the case 95 of the operating member 50. The support 96 has a plurality of protrusions 97 which stop the respective end of the ice making container 21 from rotating after the cam member 65 has rotated the entire container 21 by 135°. The cam member 65 then continues to rotate the other end of the ice making container 21 approximately by an additional 15°, thereby twisting the container 21 and causing it to drop its ice cubes into the ice reservoir 22.

The second ram member 82 of the ice level checking lever 80 rests on top of the ice in the ice reservoir 22, or upon its base should it be empty. When the ice reservoir 22 is not completely filled with ice cubes, the first and second ram members 81,82 lie approximately in the position indicated by the solid line.

The ice level checking switch 75 is turned off when the ice making container 21 is in a horizontal (upright) position and the reservoir. When the amount of ice cubes exceeds a predetermined level, the second ram member 82 is raised (as indicated by dotted line), and the first ram member 81 is moved downward so that the ice level checking switch 75 is turned on. In this manner, the control portion (not illustrated) determines that the ice reservoir 22 is filled to capacity with ice cubes.

The following description relates to the operation of the operating member 50 of the inventive ice maker.

FIG. 2A depicts the location of the cam gear 60 when the ice making container 21 is in the horizontal (upright) position.

Figure 2B:
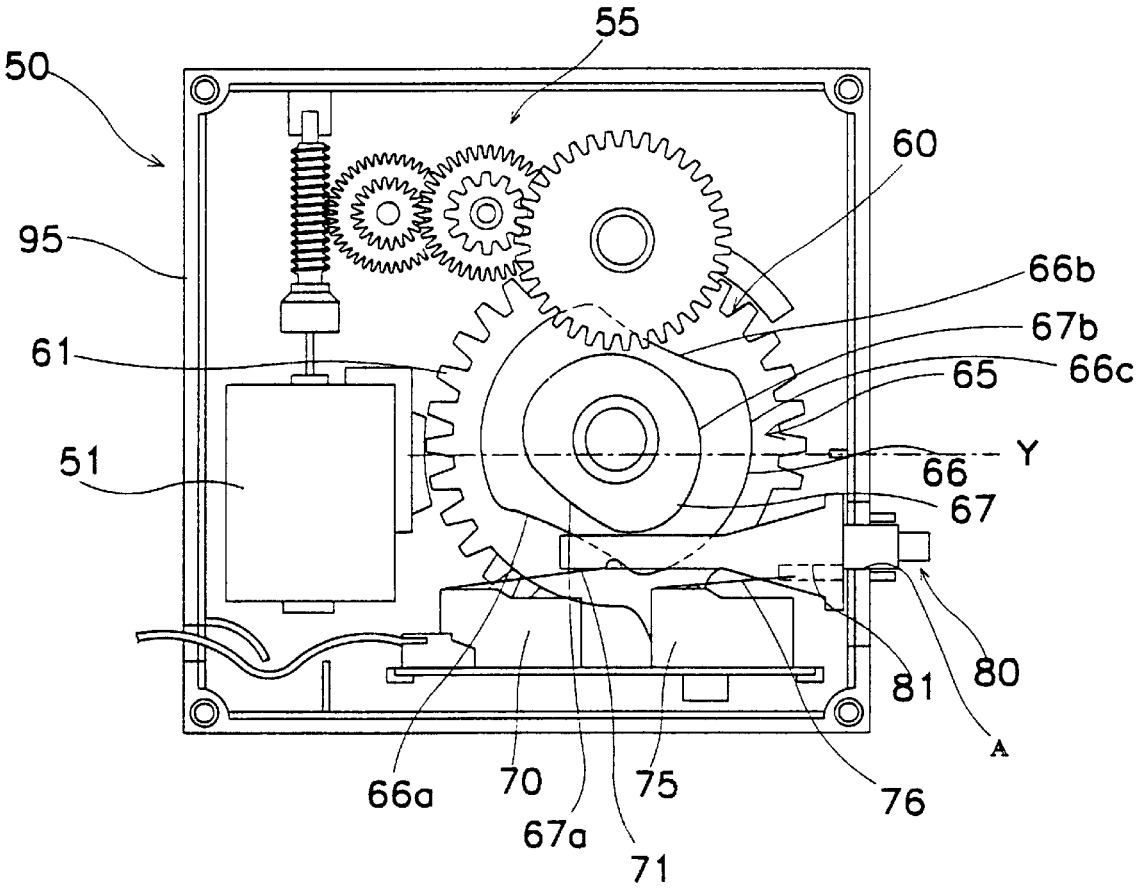

In this circumstance, the lever 71 of the horizontal position sensing switch 70 comes in contact with the first concave portion 66*a* of the first cam 66 to thereby turn off the switch 70. The first ram member 81 of the ice level checking lever 80, positioned over the lever 76 of the ice level checking switch 75, contacts the flat portion 67*a* of the second cam 67 to thereby enable the ice level checking switch 75 to be off. Referring to this, the control portion (not illustrated) determines that the ice making container 21 is in the horizontal position. After the ice making mode is completed, the control portion powers the motor 51 so that the cam gear 60 rotates clockwise as shown in FIG. 2B.

Figure 2C:
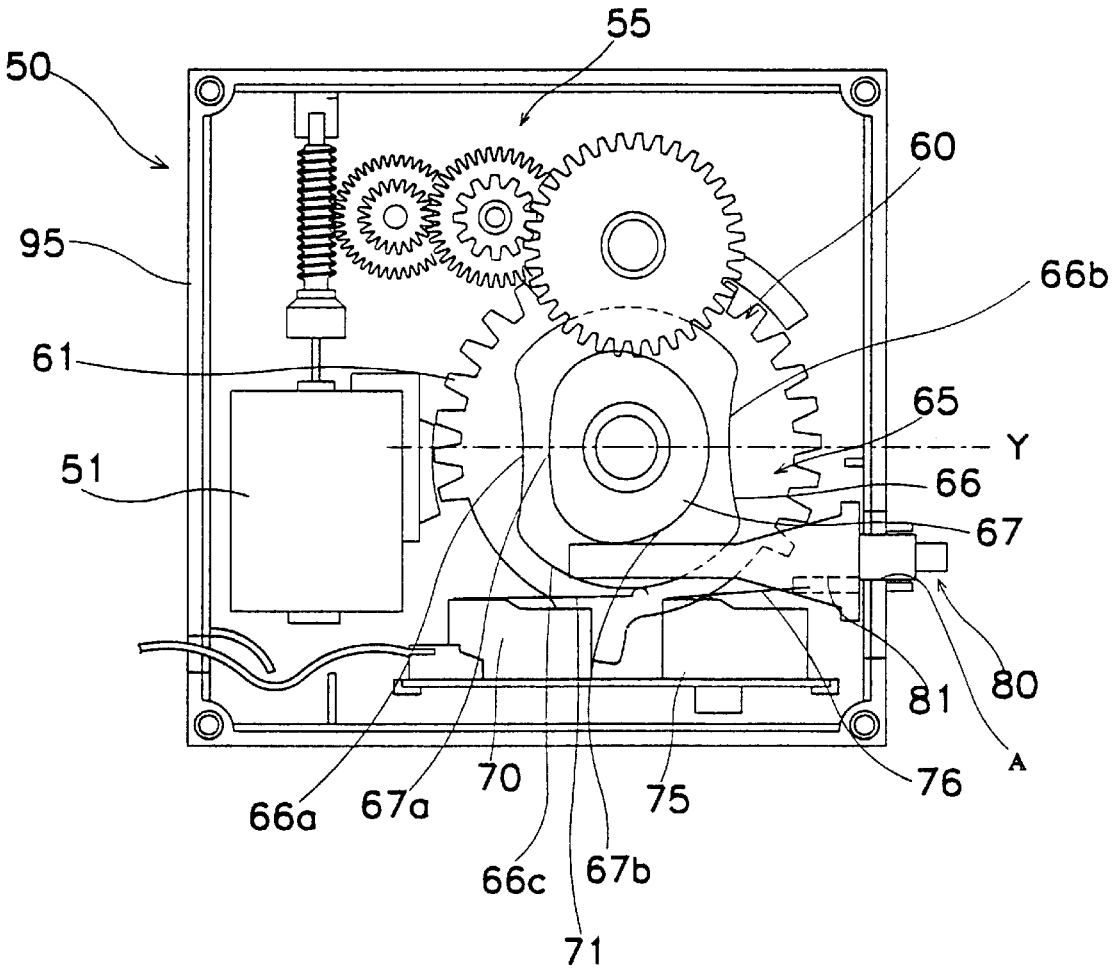

Accordingly, the rounded portion 66*c* of the first cam 66 presses the lever 71 of the horizontal position sensing switch 70 to thereby turn on the horizontal position sensing switch 70. When the cam gear 60 continues its rotation to the position depicted in FIG. 2C, the rounded portion 67*b* of the second cam 67 makes the first ram member 81 of the ice level checking lever 80 depress the ice level checking switch 75, thereby turning it on. Accordingly, the control portion determines that the ice making container 21 is rotating at present.

Figure 2D:
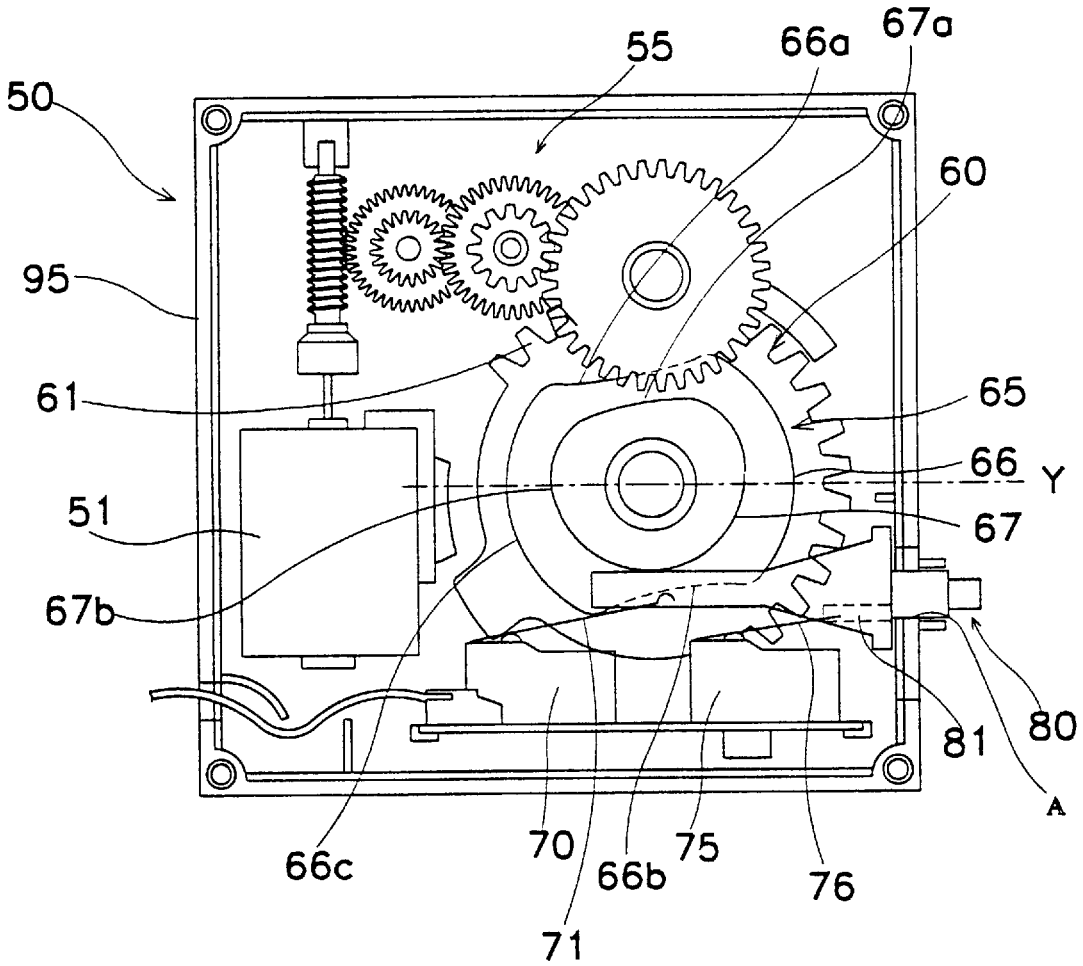
Figure 3:
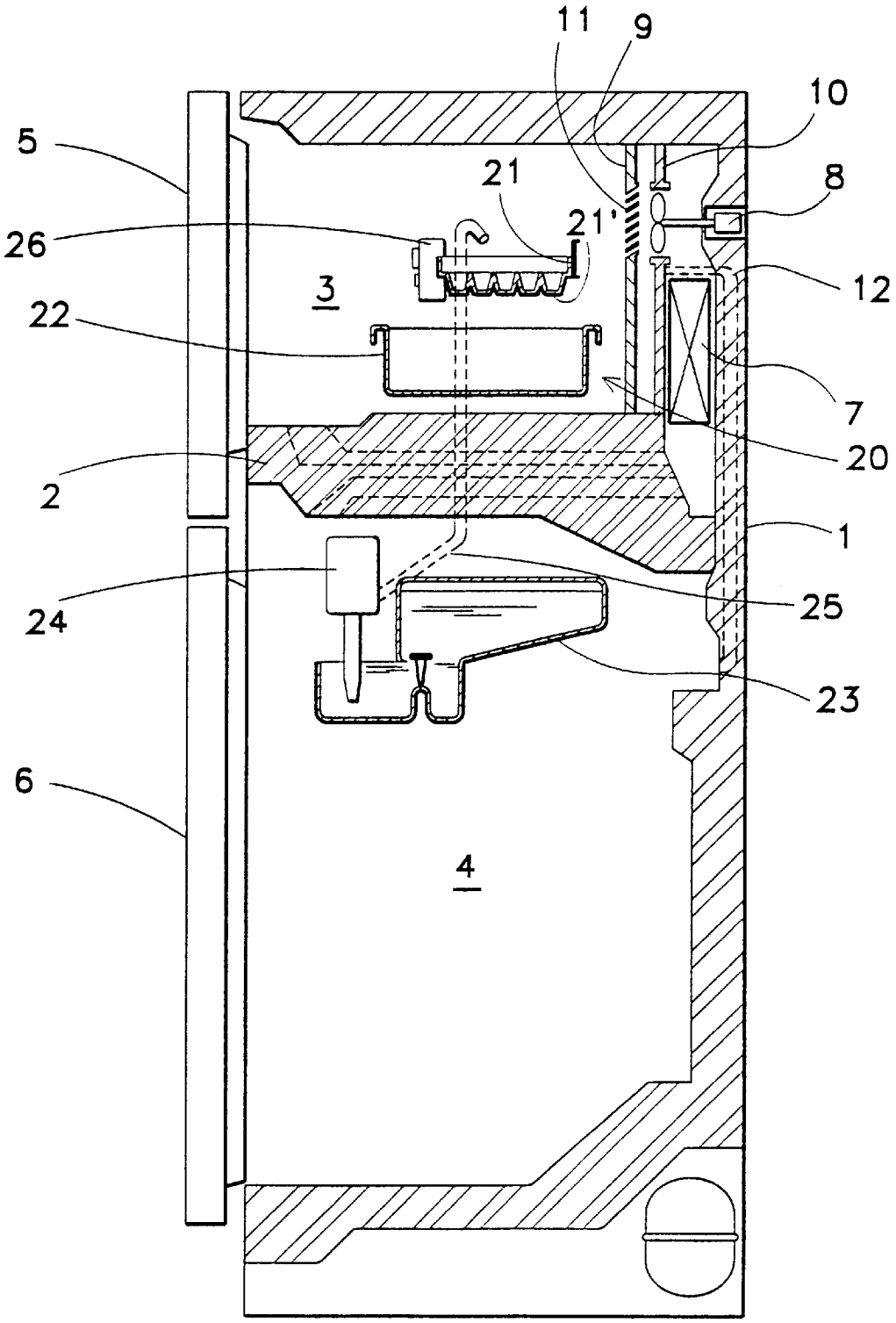
FIG.3 (PRIOR ART)
FIG. 3 is a longitudinal-sectional view of a conventional ice maker-equipped refrigerator.
Figure 4:
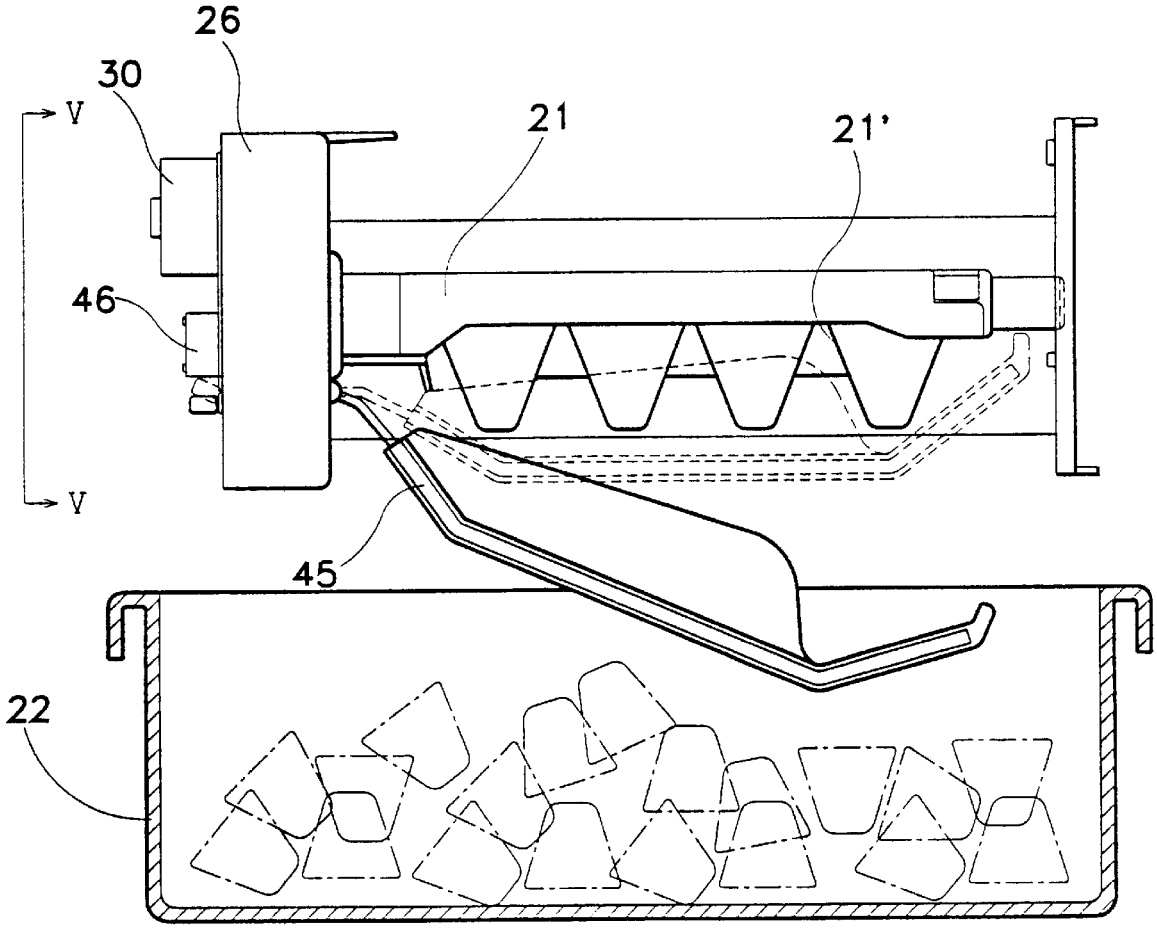
FIG. 4 (PRIOR ART)
FIG. 4 depicts the overall outward appearance of the ice maker for a refrigerator according to a prior art.
Figure 5:
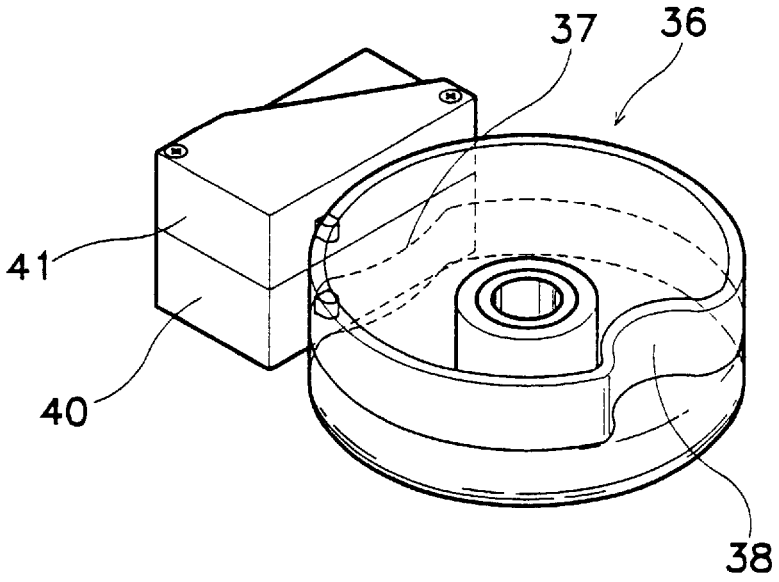
FIG.5 (PRIOR ART)
FIG. 5 is a perspective view of the operating member of the conventional ice maker as taken along line V—V in FIG. 4.
Figure 6:
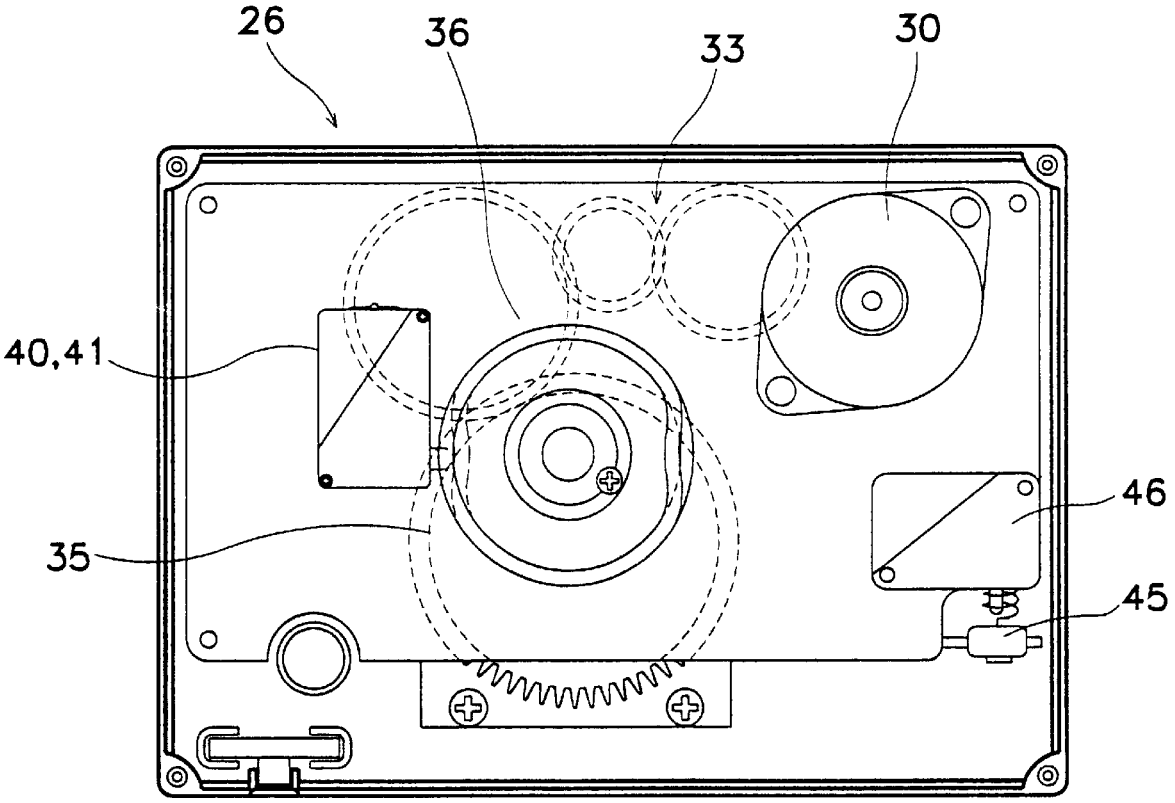
FIG.6 (PRIOR ART)
FIG. 6 is a perspective view representing the operational relationship of a conventional cam gear and switches.

As shown in FIG. 2D, when the cam gear 60 continues to rotate to the maximum angle of approximately 135°, the second concave portion 66*b* of the first cam 66 comes in contact with the lever 71 so that the horizontal position sensing switch 70 is turned off again while the ice level checking switch 75 remains on. The control portion interprets this as the ice making container 21 being rotated maximally.

Because the end of the ice making container 21 in the support 96 is restrained from rotating by the protrusions 97, the ice making container 21 is twisted a little, thereby dropping its ice cubes into the ice reservoir 22. Once the ice dropping mode is completed, the motor 51 reverses direction, rotating the cam member 65 to its original position in FIG. 2A by way of the intermediate states of FIGS. 2C and 2B. Consequently, both the switches 70 and 75 are again turned off, serving to inform the control portion that the ice making container 21 has returned to the horizontal position. The control portion stops the motor 51 after the ice dropping mode is completed, and activates a water supply pump 24 to refill the ice making container 21.

As described above, in the ice maker of the present invention, the horizontal position sensing switch and the ice level checking switch are turned on or off by one cam member, and transmit their combined signals to the control portion so that it can control the ice dropping mode and the ice level checking mode simultaneously. Besides, since the automatic ice making can be controlled with the two switches, the inventive ice maker may be of simple structure and perform the ice making mode more efficiently.

What is claimed is:

1. An automatic ice maker adapted for use in a refrigerator, comprising:

an ice tray rotatably mounted in the refrigerator;

a motor operably connected to the tray for rotating the tray between an ice-making upright position and an ice-discharging inverted position;

a container disposed below the tray for receiving ice discharged therefrom;

a first electric on/off switch;

a first cam connected for rotation with the tray for actuating the first switch between on/off states;

a second electric on/off switch;

a second cam connected for rotation with the tray for actuating the second switch between on/off states;

a controller connected to the first and second switches for determining that the tray is in an upright position in response to a first on/off relationship between the first and second switches, and in an inverted position in response to a second on/off relationship between the first and second switches, and a detector for detecting a condition when the container is full of ice and for moving the second switch to a state preventing further ice making operations when the container is full of ice, independently of the first and second cams, wherein the detector comprises a first portion adapted to contact ice in the container, and a second portion adapted to contact the second switch, the second cam arranged to act against the second portion of the detector to actuate the second switch.

2. The automatic ice maker according to claim 1 wherein the lever is mounted for rotation about an axis, the first and second portions of the lever being arranged on opposite sides of the axis.

3. The automatic ice maker according to claim 1 wherein the first switch is turned-on by the first cam when the tray is in upright and inverted states, the second switch being turned on by the second cam when the tray is out of its upright position.

4. The automatic ice maker according to claim 1, further including a rotatable cam wheel mounted for rotation with the tray, the first and second cams being affixed to the cam wheel.

5. The automatic ice maker according to claim 1 wherein the first cam comprises a round surface with first and second spaced-apart concavities formed therein, the first switch being engageable with the concavities to be turned off, and engageable with remaining portions of the round surface to be turned on.

* * * * *